United States Patent [19]

Seelinger

[11] Patent Number: 4,596,505

[45] Date of Patent: Jun. 24, 1986

[54] AUTOMATIC LOADER/UNLOADER FOR SLITTER

[75] Inventor: Hugh D. Seelinger, Tucson, Ariz.

[73] Assignee: International Business Machines Corp., Armonk, N.Y.

[21] Appl. No.: 612,279

[22] Filed: May 21, 1984

[51] Int. Cl.[4] ..... B65H 67/04

[52] U.S. Cl. ..... 414/27; 242/35.5 A; 414/222; 414/911

[58] Field of Search ..... 57/266, 268, 270, 281; 242/35.5 A, 67.1 R, 79; 414/27, 222, 225, 330, 910, 911

[56] References Cited

U.S. PATENT DOCUMENTS

| | | | |
|---|---|---|---|
| 3,999,665 | 12/1976 | Rogers | 414/911 X |
| 4,023,743 | 5/1977 | Schippers | 57/268 X |
| 4,051,652 | 10/1977 | Hirano et al. | 57/270 |
| 4,052,017 | 10/1977 | Schär | 242/35.5 A |
| 4,340,187 | 7/1982 | Schippers et al. | 242/35.5 A |
| 4,553,894 | 11/1985 | Mukae et al. | 414/225 X |
| 4,555,067 | 11/1985 | Angelucci et al. | 242/35.5 A |

*Primary Examiner*—Leslie J. Paperner
*Assistant Examiner*—Janice Krizek
*Attorney, Agent, or Firm*—J. M. Thomson

[57] ABSTRACT

When loading slit tape onto tape reels it is essential that empty reels be readily available. The present invention provides an assembly which substantially automatically transports empty reels to a loading station in a slitting machine, precisely positions the reels so that they can receive slit tape and remove the reels from the loading station after they are loaded. Each reel is engaged by a blade which moves the reel transversely between stations. The position of each blade with respect to each adjacent blade is alterable to thereby precisely position reels in the desired location.

2 Claims, 6 Drawing Figures

AUTOMATIC LOADER/UNLOADER FOR SLITTER

FIELD OF THE INVENTION

In the manufacture of typewriter ribbons and magnetic tapes it is usually necessary to slit a wide roll of ribbon or tape into narrow widths and mount these widths on take-up reels. Proper mounting of these narrow widths on take-up reels requires precise mounting of the take-up reels on a suitably located take-up arm. The precise positioning of these reels on the arm can be very time consuming if performed by hand. The present invention provides a mechanism and process for automatically loading and unloading a plurality of take-up reels on a take-up arm and precisely positioning the take-up reels on the arm.

DESCRIPTION OF THE PRIOR ART

The automatic loading and unloading of reels on rewinding machines is well known. U.S. Pat. No. 3,258,136 to Rockstrom et al describes a system in which a plurality of rewind cores can be automatically mounted in a rewind machine for winding a slit web thereon and then automatically removed from the rewind machine. However, the Rockstrom et al patent is very complicated mechanically and requires a separate jaw for handling each mounted core. The present invention avoids the problems inherent in such an arrangement by transferring all take-up rolls to and from the machine in a single unitary sliding operation while simultaneously enabling the reels to be precisely positioned in the take-up position in the slitting machine.

SUMMARY OF THE INVENTION

In a slitting machine it is essential that the slit ribbon be precisely mounted on reels. These reels may be mounted on an arm which includes on its external periphery a plurality of magnetic clutch driven hubs. On each hub is mounted a reel which is driven thereby and which receives slit tape for mounting thereon. With this arrangement, each reel can be rotated independently of each other reel to thereby maintain appropriate reeling tension on each individual reel. However, it is essential that each reel be precisely aligned on each individual hub and not interfere with the operation of any adjacent hub. To accomplish this requires a small spacing between each reel. In the past this has been accomplished by individually loading each reel on the hub. This is a time consuming and tedious process in situations where you may have as many as 30 or more hubs on which to mount reels. The present inventor has discovered a way of automatically loading reels on the hubs and unloading reels from the hubs, precisely positioning the reels on the hubs on the slitting machine and thereafter automatically removing the reels from the slitting machine and loading them onto a receiving cart.

The foregoing and other objects, features, and advantages of the invention will be apparent from the following more particular description of a preferred embodiment of the invention, as illustrated in the accompanying drawings.

DESCRIPTION OF THE PREFERRED EMBODIMENT

Figure 1:
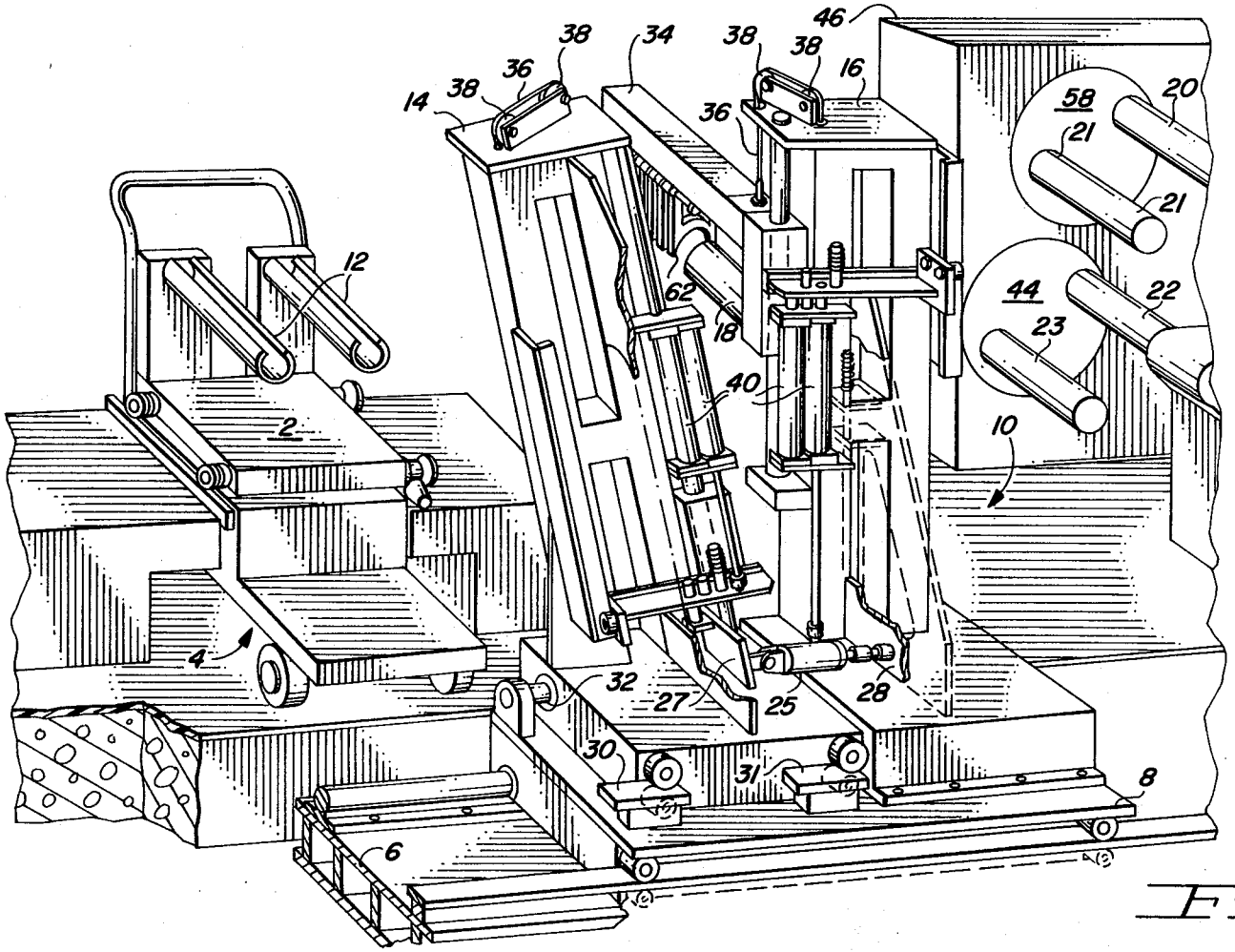
FIG. 1 is a perspective view of portions of the tape reel loading and unloading assembly.
Figures 2, 3:
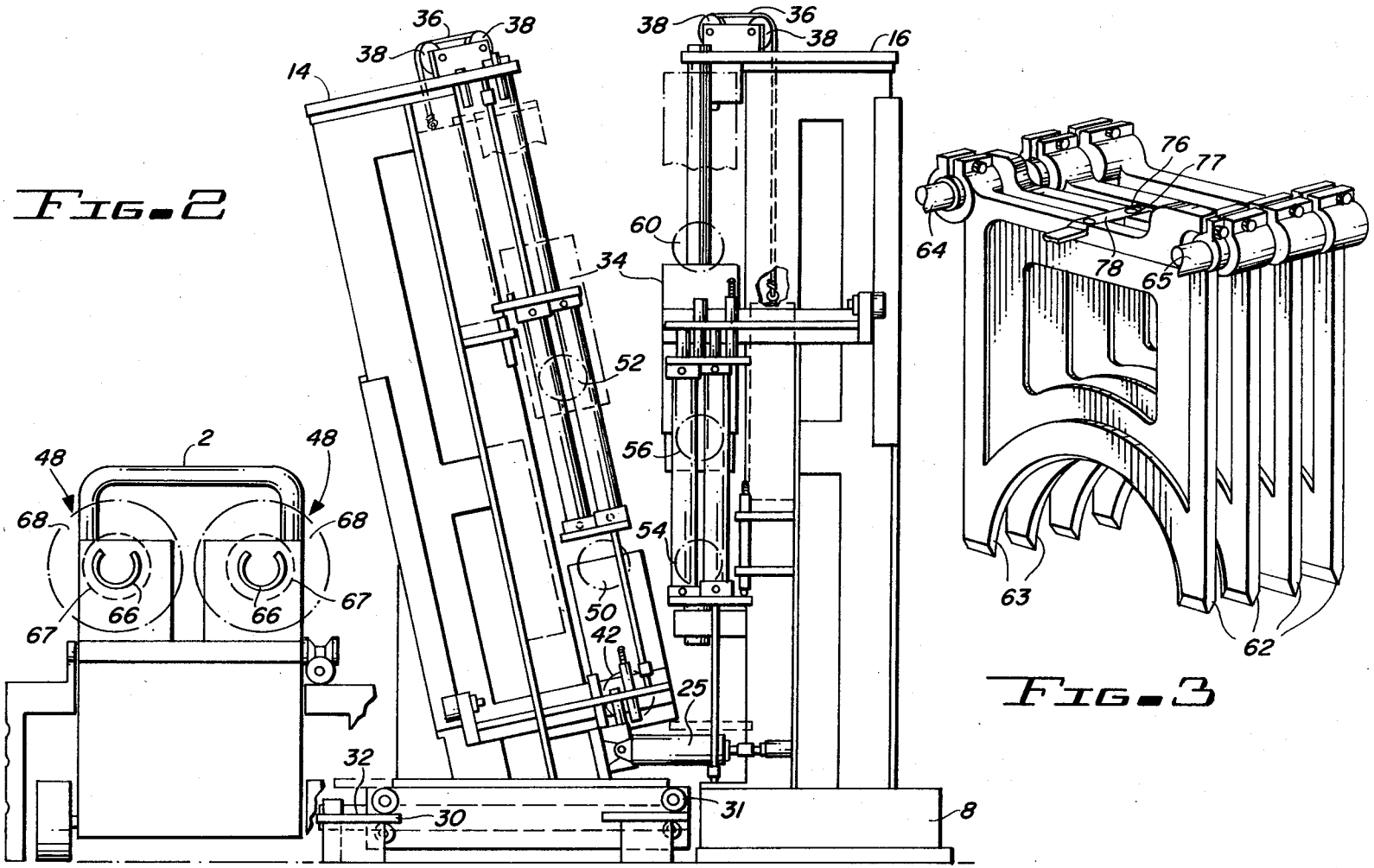
FIG. 2 is an elevation view of the assembly showing the various arbor positions.
FIG. 3 is a perspective view of a portion of the separator blade apparatus.
Figure 4:
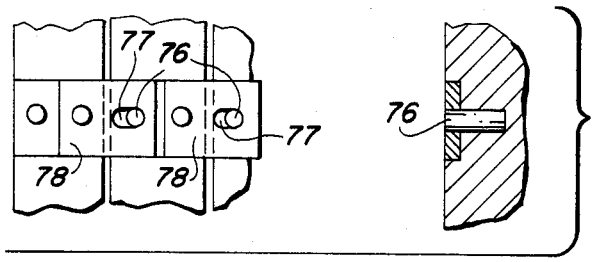
FIG. 4 shows in detail the linkage mechanism for the separation blades.
Figure 5:
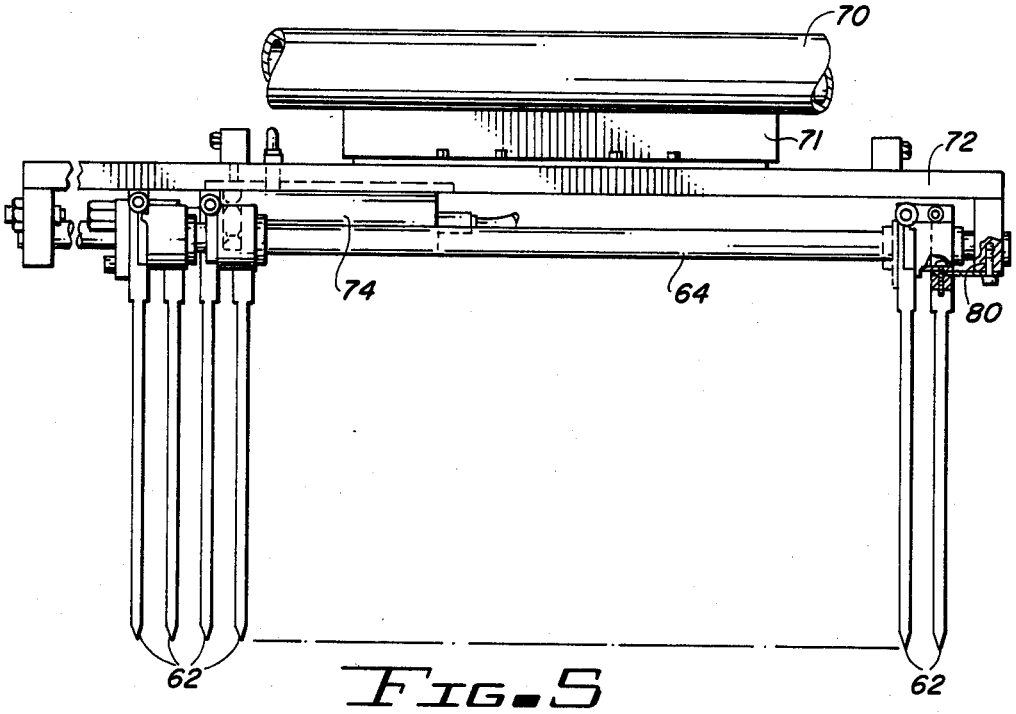
FIG. 5 is a side elevation view of the separator blade apparatus.
Figure 6:
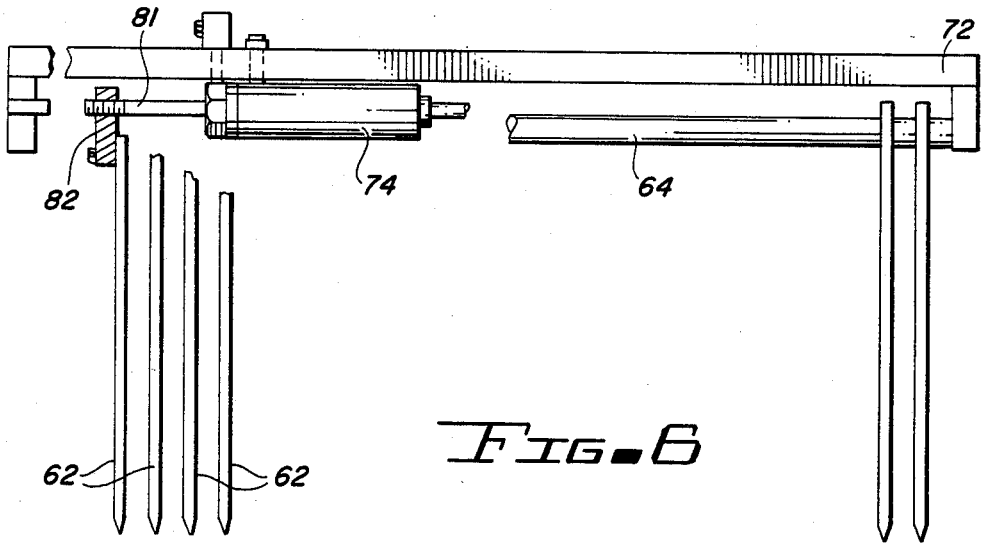
FIG. 6 is a partial side elevation view showing the connection of the operating cylinder to the blade assembly.

As shown in FIGS. 1 and 2, a guided vehicle 2 for transporting tape reels is moved into a docking station 4 next to rails which transport a transfer machine 8 from the docking station 4 to a loading station 10 at the tape slitting machine 46 (partially shown). Initially the guided vehicle 2 is loaded with empty reels (only full reels 48 are shown) which are held on the two arbors 12 on the vehicle 2. When the vehicle 2 is in the docking station 4, the transfer machine 8 is moved to the docking station 4 with the two vertical assemblies 14 and 16 adjacent the guided vehicle 2. Vertical assembly 14 is tilted slightly to enable the relative positions of the arbors (only the arbor 18 on assembly 16 is shown) on the two vertical assemblies 14 and 16 to be adjusted both vertically and horizontally with respect to one another so they can be aligned with the arbors 12 on the guided vehicle 2 and the appropriately oriented spindles 20, 21, 22 and 23 on the tape slitting machine. The relative horizontal spacing between the two vertical assemblies is alterable by means of the displacement cylinder 25 shown joined to base plates 27 and 28 of the two assemblies 14 and 16, respectively. The tilted vertical assembly 14 is moved horizontally along the short rails 30 and 31 and the cylindrical rail 32. Each vertical assembly 14 and 16 is provided with an arbor 18 and a separator blade assembly 34. Each separator blade assembly 34 and arbor 18 can be separately raised and lowered. The separator blade assembly 34 for vertical assembly 16 is raised and lowered by means of cable 36 and pulleys 38, whereas arbor 18 is raised and lowered by means of the pneumatic pistons 40. The separator blade assembly and arbor for vertical assembly 14 are raised and lowered by correspondingly positioned cable 36, pulleys 38 and pistons 40. The arbors 18 on the vertical assemblies 14 and 16 each have three positions as shown in outline on FIG. 2. The bottom position 42 of the arbor on the tilted vertical assembly 14 aligns with the appropriately oriented spindle 23 or 24 on the bottom turret 44 of the tape slitting machine 46. When the arbor is in this position, reels 48, shown loaded with tape 68, can be transferred from the vertical assembly 14 to and from the slitting machine 46. The central position 50 of the arbor on the tilted vertical assembly 14 corresponds to the position of the arbor 12 on the left of the guided vehicle 2 as viewed from the front of the vehicle 2. In this position reels 48 can be transferred to and from the guided vehicle 2 from and to the assembly 14 provided the tilted vertical assembly 14 is moved away from the upright vertical assembly 16 by means of the pneumatic cylinder 25 and rails 30, 31 and 32. When the arbor of the tilted vertical assembly 14 is in its uppermost position 52, the arbor is out of interference with any of the other apparatus. In this position it is possible to move the assembly 14 away from either the guided vehicle 2 or the tape slitting machine 46 without interfering with the operation of either of those units.

For the upright assembly 16, the lower position 54 of the arbor 18 corresponds to the position of arbor 12 on the right of the guided vehicle 2 as viewed from the front of the vehicle 2. The middle position 56 of the arbor 18 corresponds to the transfer position of the appropriate spindle 21 or 22 of the upper turret 58 of the tape slitting machine 46 and the upper position 60 of the arbor 18 again corresponds to the position in which the arbor 18 is out of interference with either the tape slitting machine 46 or the guided vehicle 2. As will be described in more detail hereinafter, reels can be transferred from the guided vehicle 2 to the vertical assemblies 14 and 16 and then transferred from the vertical assemblies 14 and 16 to the spindles 20, 21, 22 and 23 on the tape slitting machine 46 simply by aligning the arbors in their appropriate positions as indicated. However, if the actual movement of the reels 48 from the various arbors and spindles was to be performed by hand, there would be little benefit to providing such a complex transfer mechanism. In fact, the reason for providing the complex transfer assembly is to enable the actual transfer of the reels from the guided vehicle 2 to the tape slitting machine 46 to be substantially automatic. This is accomplished by providing the separator blade assembly 34 which is shown mounted on vertical assembly 16 on FIG. 1, in outline in various positions on FIG. 2, and in more detail in FIGS. 3, 4, 5 and 6.

As indicated earlier, the separator blade assembly 34 is raised by operation of the wire rope 36 and pulleys 38 shown. The assembly 34 consists of a plurality of separator blades 62 mounted on rails 64 and 65 and are normally fixed in an abutting position. In this abutting position the space between the blades 62 is sufficient to accommodate a tape reel 48. To avoid interference of the blades 62 with the reel 48, the reel 48 comprises a hub portion 66 which is wider than the spacing between adjacent separator blades 62 and a peripheral portion 67 which is the width of the tape 8 to be wound and is approximately the width of the spacing between the blades 62 so when the reels 48 are closely mounted on an arbor, the blades 62 will readily enter the gap between adjacent reels. A suitable reel design is more fully disclosed in our copending U.S. application Ser. No. 356,879, now U.S. Pat. No. 4,438,888. To assure that the separator blades 62 contact a maximum portion of the reel hub 66 for sliding the reels 48 on and off the arbors, the base 63 of the blade 62 is made semi-circular so it substantially meets the hub 66 of the reel 48 and thereby ensures maximum contact of the blade 62 with the peripheral portion 67 of the reel 62.

A cylinder 70 which has moving arms 71 mounted along the side of the cylinder 70 rather than being driven by a piston in and out of one end of the cylinder, is affixed to and moves the separator blade mounting assembly 72 as a whole from a position over the vertical assemblies 14 and 16 to positions over the tape slitting machine spindles 20, 21, 22 and 23 and guided vehicle arbors 12, as appropriate. A cylinder found particularly suitable for this application is a cylinder marketed under the tradename "Origa" by Origa Corporation. The use of an Origa cylinder, which is a cylinder having arms mounted along its side, enables the cylinder 70 to be confined in a smaller area. The more normal piston-type cylinders could be used, however, in the present case, space requirements mitigated against such use. The smaller cylinder 74 on the separator blade mounting assembly 72 enables the separator blades 62 to be slightly displaced relative to one another so the reels 48 mounted on the arbor or spindle can be slightly displaced and thereby aligned with drive hubs on the spindles 20, 21, 22 and 23 as will be subsequently described. The mechanism for enabling this slight displacement of the blades relative to one another is provided by means of dowels 76 mounted within an extended slot 77, as shown most clearly in FIG. 4. Each separator blade 62 is mounted on rails 64 and 65 as shown and is movable along those rails but is restrained from that movement by means of the expandable links 78. The expandable link 78 at one end of the separator blade mounting assembly 72 is connected to the piston 81 of the expansion and compression air cylinder 74. Operation of the air cylinder 74 moves this firmly mounted separator blade 62 which in turn causes adjacent blades 62 to move an amount corresponding to the lengths of the slots 77. The total displacement of the blade 62 which is fixed to the linkage corresponds to the total length of all the slots 77 in the expandable links 78. Each adjacent blade 62 moves a distance which is one slot less than the previous blade until the separating blade 62 at the far end of the assembly 72 does not change position at all. By this means, the relative spacing between the reels is slightly adjusted and in this application corresponds to the actual positions of the drive hubs on the spindles 20, 21, 22 and 23 on the tape slitting machine 46. Thus the tape reels 48 can be automatically loaded onto the spindles 20, 21, 22 and 23 on the tape slitting machine 46 and adjusted to position themselves precisely on the driving hubs and out of interfering contact with one another.

The tape reel loading and unloading operation will now be described in detail. A guided vehicle 2, either manually or automatically operated, is loaded with a stack of reels 48 not including tape 68. The reels 48 are mounted on the two arbors 12 of the vehicle 2 in a closely stacked array and held on by a clamping mechanism (not shown) at the end of each arbor 12. The vehicle 2 is then moved into position at a docking station 4 located on the path of the reel transfer machine. When the vehicle 2 is properly positioned in the docking station 4, the two vertical assemblies 14 and 16 of the transfer machine are moved into position adjacent the vehicle 2 and the arbor 18 on each vertical assembly 14 and 16 is positioned in end abutting engagement with one of the arbors 12 on the vehicle. In other words, the arbor 18 on assembly 14 is lowered to position 50 and the arbor 18 on assembly 16 is lowered to position 54 and cylinder 25 is operated to place assemblies 14 and 16 as far apart as possible. The engagement of the arbors 12 and 18 releases the clamping mechanism on each arbor 12 on the vehicle 2. The Origa (trademark) cylinder 70 on each vertical assembly 14 and 16 then moves the separator blades 62 over the reels 48 on the vehicle arbors 12 and the blades 62 are lowered to positions between the reels 48 by means of the wire rope 36 and pulley 38 arrangement on the vertical assemblies 14 and 16. The Origa cylinder 70 then moves the separator blades 62 toward the respective vertical assembly 14 or 16 and thereby moves the reels 48 off the vehicle arbors 12 and onto the arbors 18 on the vertical assembly 14 or 16. At this point, the reels 48 remain closely packed together. Also the reels 48 are retained in substantially the same position on both arbors 18.

When the transfer of the reels 48 from the vehicle 2 to the vertical assemblies 14 and 16 is complete the vehicle arbors 12 are released and the vertical assemblies 14 and 16 can be moved into position adjacent the turrets 44 and 58 of the tape slitting machine 46. The tape slitting machine 46 has an upper turret 58 and lower turret 44. Turret 58 has a pair of spindles 20 and 21 disposed 180° from each other and turret 44 has a similar pair of spindles 22 and 23. Since the reel loading and unloading position of the two turrets 44 and 58 does not correspond to the position of the arbors 12 on the vehicle 2, the arbors 18 on the vertical assemblies 14 and 16 must be raised or lowered and the relative distance between the two arbors 18 on the vertical assemblies 14 and 16 must be changeable. To accomplish this, the vertical assembly 14 has been constructed at an angle (approximately 12° from the vertical) to the vertical and provision has been made to move the vertical assemblies 14 and 16 horizontally relative to one another. The arbors 18 with unloaded reels 48 are now aligned with spindles (shown as 21 and 23 in FIG. 1) on the tape slitting machine turrets 44 and 58 and temporarily coupled to the spindles 21 and 23. The Origa cylinder 70 on each vertical assembly 14 or 16 is now operated to move the attached separator blade mounting assembly 72 towards the slitting machine spindles 21 and 23 and thereby slide the empty reels onto the spindles 21 and 23. During this operation, the cylinder 70 for one of the assemblies 14 or 16 moves the separator blade mounting assembly 72 approximately one-half inch further onto the spindle 21 or 23 than the other cylinder 70. This provides one-half inch displacement between respective reels 48 on each spindle 21 and 23. This one-half inch displacement is required to accommodate the slitting machine 46 where the tape is slit into one-half inch widths. If a different width were being slit, then a correspondingly different displacement amount would be required. Each adjacent strip of tape is to be wound on different spindles so that there will be no winding interference between adjacent reels. The tape winding operation is more fully described in our copending application Ser. No. 356,879, now U.S. Pat. No. 4,438,888 identified hereinabove. As the actual winding of the tape is not part of the present invention, it will not be further described herein. To finally position the reels 48 on the hubs of the spindles 21 and 23, a small displacement cylinder 74 which has a piston 81 connected by plate 82 to a separator blade 62 at one end of the group of blades 62 is operated. Operation of this cylinder 74 causes dowel pins 76 connected to the separator blades 62 to shift within slots 77 and displace each separator blade 62 with respect to adjacent separator blades 62. Each separator blade 62 is mounted with a dowel pin 76 extending through an expanded slot 77 and the movement of the cylinder 74 causes each dowel 76 to move within its slot 77 and thereby cause displacement of all the separator blades 62 with respect to one another. The movement of the separator blades 62 causes the reels 48 on the spindles 21 and 23 to separate and thereby precisely position themselves on driving hubs on the spindles 21 and 23 for driving connection therewith. The separator blades 62 are then raised from between the reels 48 and the arbors 18 on the vertical assemblies 14 and 16 are also separated from the spindles 21 and 23. The arbors 18 are also raised to a position which will not interfere with the tape reels 48 on the spindles 21 and 23. The turrets 44 and 58 are now rotated 180° to locate the empty tape reels 48 in position to be loaded with tape 68. After the reels 48 are loaded, the turret supporting the loaded reels 48 is rotated through another 180° to return the spindles 21 and 23 to their original position. The vertical assemblies 14 and 16 then return the arbors 18 to mating engagement with the spindles 21 and 23 and the separator blades 62 are again lowered to positions between the now loaded reels 48. The Origa cylinder 70 is operated to retreat the separator blades 62 back to the arbors 18 on the vertical assemblies 14 and 16 and thereby mount the loaded reels 48 onto the vertical assemblies 14 and 16.

After the vertical assemblies 14 and 16 are loaded, the spindles 21 and 23 and arbors 18 are disengaged and the vertical assemblies 14 and 16 are moved back to the docking station 4 where a guided vehicle 2 is waiting to receive the loaded reels 48. The arbors 18 on the two vertical assemblies 14 and 16 are lowered to positions 50 and 54 respectively, which are at the same level as the arbors 12 on the guided vehicle 2 and the vertical assemblies 14 and 16 are also moved further apart by the displacement cylinder 25. These two movements serve to align the arbors 18 on the vertical assemblies 14 and 16 with the arbors 12 on the guided vehicle 2.

When the arbors 12 and 18 are aligned, the Origa cylinders 70 are again operated so that the separator blades 62 move the loaded reels 48 from the vertical assembly arbors 18 to the guided vehicle arbors 12. When the guided vehicle arbors 12 are loaded, the separator blades 62 are raised away from the reels 48 and the arbors 12 and 18 are disengaged. The guided vehicle 2 carrying the loaded reels 48 may then be removed from the docking station 4 and another guided vehicle carrying empty reels moved into the docking station 4. The process is then repeated with the new set of reels.

It is obvious that the actual operation of the tape slitter and reel loader/unloader will be somewhat more complex than the simple process described hereinabove. For example, it would be expected that all four spindles on the tape slitter would be in use at all times. While the reels on two of the spindles are being loaded with slit tape, a set of full reels would normally be unloading from the other two spindles and replaced with a set of empty reels. Consequently, the vertical assemblies 14 and 16 of the tape loader/unloader would be continuously moving back and forth between the docking station 2 and the tape slitting machine 46 while slit tape is being loaded onto the empty reels 48. This increasing complexity of the actual operation and the concurrent performance of different functions does not alter the nature of the individual motions and operations that are performed except that the separator blades 62 and arbors 18 may have to be repositioned more frequently to avoid interference with the tape reels 48.

We have described above the operation of the load and unload mechanism. There are a number of features which should be particularly noted. The separation blades 62 should have a planar shape similar to that shown in FIG. 3. The reason for this is that the blades should engage a substantial area of the surface of the reels 48 so that the possibility of binding or twisting of the reels 48 while they are moving onto and off the arbors 12 and 18 and spindles 20, 21, 22 and 23 is prevented. If the blades 62 only engaged the upper edges of the reels 48, it is entirely possible that the reels 48 could be twisted and bind on the arbors and spindles.

Although the present inventor prefers to use hydraulic mechanisms for lifting and moving the various parts of the assembly, it would be possible to use other electro-mechanical arrangements for accomplishing the same purpose.

In essence the present inventor has devised a technique for automatically loading and unloading reels from a slitting machine or the like whereby the positioning of the reels may be precisely controlled.

While the invention has been particularly shown and described with reference to a preferred embodiment thereof, it will be understood by those skilled in the art that various changes in form and details may be made therein without departing from the spirit and scope of the invention.

What is claimed is:

1. In a reel handling device for loading and unloading a plurality of reels from a common spindle, said device having an arbor for carrying said reels, comprising:

means for aligning said arbor with said spindle;

a plurality of blades engageable with said reels;

means for moving said blades between said spindle and said arbor while engaging said reels to transport said reels between said spindle and said arbor;

means for extending said blades into separated positions when said reels are on said spindle and into closely spaced positions when said reels are on said arbor to thereby separate said reels when on said spindle and closely position said reels when on said arbor.

2. A system for transferring empty reels from a transport vehicle to a slitting machine and loaded reels from said slitting machine to said transport vehicle wherein said transport vehicle has at least one arbor for supporting a plurality of reels and said slitting machine has at least one spindle for supporting the same plurality of reels, said system comprising:

at least one assembly movable from a position adjacent said transport vehicle to a position adjacent said slitting machine;

at least one arbor on said assembly, each said at least one arbor on said assembly being capable of carrying said plurality of reels;

means for positioning said at least one arbor on said assembly, said means for positioning said at least one arbor on said assembly in mating engagement with said arbor on said vehicle when said assembly is adjacent said transport vehicle and in mating engagement with said spindle when said assembly is adjacent said slitting machine;

a separator blade assembly on each said at least one assembly;

means for moving each said blade assembly into and out of association with said arbors and said spindle;

a plurality of blades on each said blade assembly, each said blade engageable with a reel;

means for moving said separator blade assembly from or to a position in association with said at least one arbor on said vehicle or said spindle to or from a position in association with said at least one arbor on said assembly when said at least one arbor on said assembly is in mating engagement with said at least one arbor on said vehicle or said spindle, respectively, to thereby enable a plurality of reels to be transferred from or to a position on said at least one arbor on said vehicle or said spindle, respectively, to or from a position on said at least one arbor on said assembly;

link means associated with said means for moving, said link means comprising a link associated with each blade, each said link having an elongated slot engageable by a pin means extending from an associated blade; and means for shifting each pin means within an associated link to thereby shift said blades a fixed amount relative to one another whereby, when said blade assembly is in engaging relationship with said reels, said reels may be displaced relative to one another by moving said pin means within each slot.

* * * * *